US005376616A

United States Patent [19]

Hamano et al.

[11] Patent Number: 5,376,616

[45] Date of Patent: Dec. 27, 1994

[54] REVERSIBLE HEAT-SENSITIVE RECORDING COMPOSITION AND REVERSIBLE HEAT-SENSITIVE RECORDING SHEET

[75] Inventors: Katsuhisa Hamano; Yutaka Nakabayashi, both of Osaka, Japan

[73] Assignee: Nitto Denko Corporation, Japan

[21] Appl. No.: 172,079

[22] Filed: Dec. 23, 1993

[30] Foreign Application Priority Data

Dec. 25, 1992 [JP] Japan ..... 4-358265

[51] Int. Cl.[5] ..... B41M 5/28

[52] U.S. Cl. ..... 503/216; 106/21 R; 503/201; 503/217; 503/225

[58] Field of Search ..... 106/21 R; 503/201, 217, 503/225, 216

[56] References Cited

U.S. PATENT DOCUMENTS 4,687,862 8/1987 Obitsu et al. ..... 106/21

*Primary Examiner*—Pamela R. Schwartz

*Attorney, Agent, or Firm*—Sughrue, Mion, Zinn, Macpeak & Seas

[57] ABSTRACT

A reversible heat-sensitive recording composition capable of repeatedly writing or erasing, and a reversible heat-sensitive recording sheet using the composition are disclosed. The reversible heat-sentitive recording composition comprising a leuco compound as a coloring agent and a pyridine derivative having at least one substituent selected from the group consisting of a carboxyl group and a phenolic hydroxyl group.

7 Claims, No Drawings

REVERSIBLE HEAT-SENSITIVE RECORDING COMPOSITION AND REVERSIBLE HEAT-SENSITIVE RECORDING SHEET

FIELD OF THE INVENTION

The present invention relates to a composition for a heat-sensitive recording medium having a reversibility and to a reversible heat-sensitive recording sheet capable of forming images using the composition. More specifically, the present invention relates to a reversible heat-sensitive recording composition capable of repeatedly writing or erasing by changing a manner of giving a heat energy and to a reversible heat-sensitive recording sheet using the composition.

BACKGROUND OF THE INVENTION

Recently, information processing devices such as a word processor, a personal computer, a facsimile, etc., have rapidly become widespread. With the widespread development of the information processing devices, the necessity of making hard copies of the outputs from these terminals has been increased. Various recording systems such as a heat-sensitive recording system, a heat transfer system, an electrophotographic system, an ink jet recording system, etc., have been practically used as a recording system for such a hard copy.

However, in the recording system which is practically used at present, the once recorded content of an output is semi-permanently kept and a paper used for recording cannot be used again. Thus, a large amount of recording papers have been consumed at the terminals of various information processing devices. Recently, the recognition for the preservation of the environment of the earth and for the conservation of natural resources has been increased and it has been required to use materials capable of recycling as the recording media used for printers. However, a recording paper capable of repeatedly conducting an image formation and erasing is not yet obtained at present.

Furthermore, a payment by a credit card, a prepaid card, etc., has been popularized and a so-called cashless system is being actively used. The information recorded on such a credit card, a prepaid card, etc., is generally a magnetically recorded information, an optically recorded information, an IC memory, etc. It has also been desired to convert the information which is recorded on such a card and cannot be detected visually into a visible information for the convenience of users.

From such a standpoint, a recording sheet having formed thereon a reversible heat-sensitive recording material comprising a binder having dispersed therein an organic low molecular weight material such as a higher fatty acid, etc., as the heat-sensitive recording layer is proposed and is being practically used (European Patent No. 868). However, the recording sheet records an information or an image by heating as a white turbid state in a transparent state by the difference in the sizes of crystals and hence in principle, an information or an image having both a sufficient density and a sufficient contrast is not obtained in the recording sheet and further it is impossible to obtain a colored information or image.

PCT Patent Publication (unexamined) WO/11898 proposes a composition capable of coloring and erasing an image by using an amphoteric compound having a hydroxyl group and a carboxyl group and also having inevitably an amino group as a pyridine derivative and conducting a chemical reaction while controlling a heat energy. When the composition is coated on a substrate to form a recording sheet, the recording sheet is colored by heating with a thermal head, etc., for a short period of time (from few milli-seconds to few tens milli-seconds) and decolored by heating for a long period of time (about several seconds). The invention of the above-described PCT patent publication can also provide a reversible color heat-sensitive recording medium having a good visibility and capable of repeatedly coloring and decoloring.

However, the composition described in WO/11898 described above has the disadvantages that when the colored records are allowed to stand under an ordinary storage condition, the record is decolored with the passage of time, and also at erasing the colored images by heating, color residues are formed to some extent and the recorded color images cannot be completely eliminated.

SUMMARY OF THE INVENTION

Accordingly, one object of the present invention is to provide a reversible heat-sensitive composition that the colored recording medium made thereof shows small decoloring with the passage of time and at erasing the color, the color can be almost completely erased without leaving color residue.

Another object of the present invention is to provide a reversible heat-sensitive recording sheet using the composition.

As a result of various investigations to find specific pyridine derivatives to overcome the above problems, it has been found that the above objects can be attained by combining a specific pyridine derivative and a leuco compound. The present invention has been accomplished based on this finding.

According to one embodiment of the present invention, there is provided a reversible heat-sensitive recording composition containing a leuco compound as a coloring agent and a pyridine derivative having at least one substituent selected from the group consisting of a carboxyl group and a phenolic hydroxyl group.

According to another embodiment, of the present invention, there is provided a reversible heat-sensitive recording sheet using the composition.

DETAILED DESCRIPTION OF THE INVENTION

The present invention is described in detail below.

The composition of the present invention contains a specific pyridine derivative and a leuco compound as the essential components. It is necessary that the specific pyridine derivative used in the present invention is a pyridine derivative having at least one of a carboxyl group and a phenolic hydroxyl group and any of such pyridine derivatives can be used in the present invention.

Examples of the pyridine derivative are nicotinic acid, isonicotinic acid, picolinic acid, pyridine-2,3-dicarboxylic acid, pyridine-2,4-dicarboxylic acid, pyridine-2,5-dicarboxylic acid, pyridine-2,6-dicarboxylic acid, pyridine-3,4-dicarboxylic acid, pyridine-3,5-dicarboxylic acid, 2-pyridone, 3-pyridone, 4-pyridone, 2,3-pyridinediol, 2,4-pyridinediol, 2,5-pyridinediol, 2,6-pyridinediol, 3,4-pyridinediol, 3,5-pyridinediol, and citrazinic acid.

The balance between the strength of the acidic property and the strength of the basic property is important for the specific pyridine derivative used in the present invention. The specific pyridine derivatives are compounds represented by following formula (A) and following formula (B)

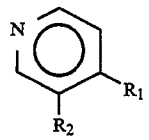

(A)

wherein $R_1$ represents a carboxyl group or a phenolic hydroxyl group and $R_2$ represents hydrogen atom, a carboxyl group, or a phenolic hydroxyl group;

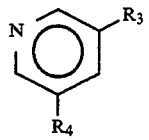

(B)

wherein $R_3$ represents a carboxyl group or a phenolic hydroxyl group and $R_4$ represents hydrogen atom, a carboxyl group, or a phenolic hydroxyl group.

The leuco compounds which can be used for the composition of the present invention are various conventional leuco compounds which are colored or decolored by heating. Examples of the leuco compound used in the present invention are Crystal Violet Lactone (blue), 2-anilino-3-methyl-6-dibutylaminofluoran (black), 2-(2-chloroanilino)-6-dibutylaminofluoran (black), 2-(2-chloroanilino)-6-diethylaminofluoran (black), 2-N,N-dibenzylanilino-6-diethylaminofluoran (green), and 6-diethylamino-benzo[a]-fluoran (red), but the leuco compound used in the present invention is not limited to these compounds.

The composition of the present invention may further contain a proper binder. The binder which can be used is conventional resins which are dissolved in water or an organic solvent. Examples of the resins are homopolymers and copolymers such as polyvinyl alcohol, methyl cellulose, ethyl cellulose, cellulose acetate, nitrocellulose, polystyrene, polyvinyl chloride, polyvinyl acetate, saturated polyester, methyl polymethacrylate, ethyl polymethacrylate, polyurethane, polyvinyl butyral, etc., although the present invention is not limited to these resins.

The composition of the present invention may further contain a proper modifier such as a lubricant, etc.

It is preferred in the composition of the present invention that the amount of the leuco compound added is from 0.1 to 1.0 part by weight, preferably from 0.5 to 0.9 part by weight, per 1 part by weight of the pyridine derivative. If the amount of the leuco compound added is less than 0.1 part by weight, a sufficient optical density of the image is not obtained, while if the amount is larger than 1 part by weight, erasing of the image becomes insufficient.

Further, it is preferred that the amount of the binder added in the present invention is 5 parts by weight or less per 1 part by weight of the pyridine derivative. If the amount thereof is more than 5 parts by weight, a sufficient optical density of the image is not obtained.

The reversible heat-sensitive recording sheet is produced by dissolving or dispersing the composition in water or an organic solvent to obtain a coating composition and coating the coating composition on a proper support to form a recording layer.

The support which can be used is a proper material such as a paper, a synthetic paper, a plastic film, etc. In this case, for improving the adhesion of the recording layer or for static prevention, various surface treatments may be applied to the support.

At coating, proper additives such as a thickener, etc., may be added to the coating composition.

There is no particular restriction on the coating method, and various coating methods such as a bar coating method, a blade coating method, an air knife coating method, a gravure coating method, a kiss coating method, a fountain coating method, a fountain reverse coating method, etc., can be used.

The amount of the coating composition coated is preferably from 3 to 10 g/m$^2$ (dry thickness). Further, a protective layer may be formed on the recording layer.

The recording layer of the heat-sensitive recording sheet of the present invention colors by short-time heating. The heating time required for coloring is very short. For example, in the case of using a thermal head, the heating time may be from few milli-seconds to few tens milli-seconds. The heating temperature is usually same as the heating temperature of a thermal head.

The recording layer thus colored is alecolored by heating for a long period of time. "Long-time heating" used herein means heating for a time longer than the heating time required for coloring the recording layer, and the heating time is only about from 1 to few seconds. The temperature required for decoloring is from 80° to 110° C. and when the color of the recording layer is decolored at the temperature, a color residue scarecely remains. In addition, the color of the recording layer is scarecely decolored at a temperature lower than the above decoloring temperature, and the colored information is sufficiently maintained.

A leocu compound usually causes a coloring reaction at an acidic state, while causes a decoloring reaction at a basic state.

An acidic material opens the lactone ring of a colorless leuco compound by the applied heat energy to give a color. On the other hand, when the compound having the open lactone ring is contacted with a basic material, the lactone ring is closed and the compound becomes the original colorless leuco compound.

The pyridine derivative used in the present invention is an amphoteric compound and has a carboxyl group or a phenolic hydroxyl group showing an acidic property, and a nitrogen atom (N atom) of the pyridine ring showing a basic property, in one molecule. When the pyridine derivative is contacted with a leoco compound and heated, it is considered that a coloring reaction and a decoloring reaction probably occur simultaneously. However, reaction rate of the coloring reaction is higher and hence it is assumed that when the recording layer containing the pyridine derivative and the leuco compound is heated with a thermal head for a short period of time (from few milli-seconds to few tens milli-seconds) and cooled, the colored state is maintained. On the other hand, when the recording layer is heated for a long period of time (longer than few hundreds milli-seconds), the system becomes an equilibrium state which is considered to be a decolored state and it is assumed that when the system is cooled, the decolored state is maintained.

The present invention is described in more detail by the following examples but the invention is not limited to these examples. In addition, in the examples, all parts are by weight unless otherwise indicated.

EXAMPLE 1

| | Amount (parts) |
|---|---|
| Liquid A: | |
| 3,3-Bis(4,dimethylaminophenyl)-6-dimethylaminophthalide | 10 |

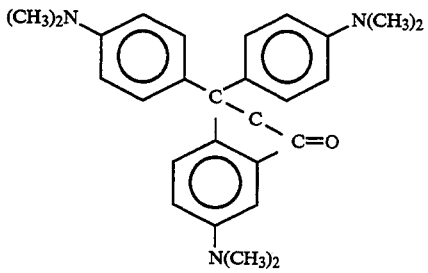

| | |
|---|---|
| Vinyl Chloride-Vinyl Acetate Copolymer Resin | 5 |
| Toluene | 40 |
| Methyl Ethyl Ketone | 10 |
| Liquid B: | |
| Nicotinic Acid | 10 |
| Vinyl Chloride-Vinyl Acetate Copolymer Resin | 7.5 |
| Toluene | 40 |
| Methyl Ethyl Ketone | 10 |

After dispersing each of liquid A and liquid B described above in a ball mill for 5 hours, 1 part of liquid A, 4 parts of liquid B, 1.6 parts of toluene, and 0.4 part of methyl ethyl ketone were sufficiently mixed to obtain a coating liquid. The coating liquid was coated on a white polyester film having a thickness of 75 μm using a wire bar at a coating amount of 5 g/m$^2$ (dry thickness) to form a recording layer, thereby obtaining a reversible heat-sensitive recording sheet.

EXAMPLE 2

| | Amount (parts) |
|---|---|
| Liquid A: | |
| 2-Anilino-3-methyl-6-dibutylaminofluoran | 10 |

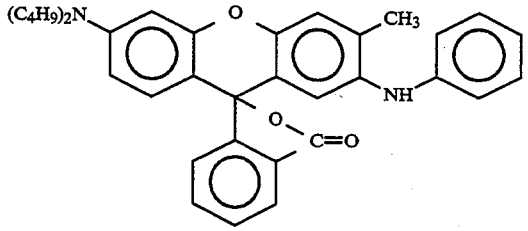

| | |
|---|---|
| Polyvinyl alcohol | 3 |
| Phosphoric Acid Ester Surfactant | 1 |
| Water | 40 |
| Isopropyl Alcohol | 10 |
| Liquid B: | |
| 4-Pyridone | 10 |
| Polyvinyl Alcohol | 10 |
| Water | 40 |
| Isopropyl Alcohol | 10 |

After dispersing each of liquid A and liquid B described above in a ball mill for 5 hours, 1 part of liquid A, 6 parts of liquid B, 1.6 parts of water, and 0.4 part of isopropyl alcohol were sufficiently mixed to obtain a coating liquid. The coating liquid was coated on a wood free paper having a basis weight of 60 g/m$^2$ using a wire bar at a coating amount of 5 g/m$^2$ (dry thickness) to form a recording layer, thereby obtaining a reversible heat-sensitive recording sheet.

EXAMPLE 3

| | Amount (parts) |
|---|---|
| Liquid A: | |
| 6-Diethylamino-benzo[a]-fluoran | 10 |

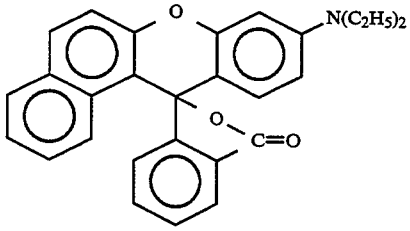

| | |
|---|---|
| Saturated Polyester Resin | 7 |
| Toluene | 40 |
| Methyl Ethyl Ketone | 10 |
| Liquid B: | |
| 2,4-Pyridinediol | 10 |
| Saturated Polyester Resin | 5 |
| Toluene | 40 |
| Methyl Ethyl Ketone | 10 |

After dispersing each of liquid A and liquid B described above in a ball mill for 5 hours, 1 part of liquid A, 2 parts of liquid B, 1.6 parts of toluene, and 0.4 part of methyl ethyl ketone were sufficiently mixed to obtain a coating liquid. The coating liquid was coated on a polypropylene synthetic paper having a thickness of 150 μm using a wire bar at a coating amount of 5 g/m$^2$ (dry thickness) to form a recording layer, thereby obtaining a reversible heat-sensitive recording sheet.

COMPARATIVE EXAMPLE 1

By following the same procedure as in Example 1 except that liquid B having the following composition was used as the liquid B in Example 1, a reversible heat-sensitive recording sheet was prepared.

| | Amount (parts) |
|---|---|
| Liquid B: | |
| Compound having the following structure | 10 |

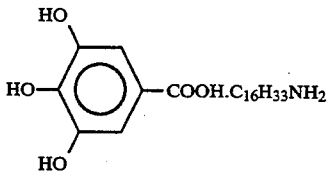

| | |
|---|---|
| Vinyl Chloride-Vinyl Acetate Copolymer Resin | 7.5 |
| Toluene | 40 |
| Methyl Ethyl Ketone | 10 |

COMPARATIVE EXAMPLE 2

By following the same procedure as in Example 2 except that liquid B having the following composition was used as the liquid B in Example 2, a reversible heat-sensitive recording sheet was prepared.

| Liquid B: | Amount (parts) |
|---|---|
| p-Aminobenzoic Acid | 10 |
| Polyvinyl Alcohol | 10 |
| Water | 40 |
| Isopropyl Alcohol | 10 |

When each of the reversible heat-sensitive recording sheets prepared in Examples 1 to 3 and Comparative Examples 1 and 2 was printed by a thermal head (printing electric power 0.5 watt/dot, pulse width 2 milliseconds), a clear image was obtained in each case. When these printed samples were stored a whole day and night at room temperature, the image only of the sample prepared in Comparative Example 1 was faded.

Furthermore, when these printed samples were placed in a hot blast dryer kept at 110° C. for few seconds, the images of the printed samples prepared in Examples 1 to 3 were completely eliminated. On the other hand, the image of the printed sample in Comparative Example 2 was not completely eliminated.

When the same printing and eliminating operations were repeatedly applied to the reversible heat-sensitive recording sheets prepared in Examples 1 to 3, it was confirmed that they had a reproducibility and were excellent as reversible heat-sensitive recording sheets.

As described above, the composition for a reversible heat-sensitive recording medium of the present invention is such that a colored image obtained shows small decoloring with the passage of time and on the other hand, at eliminating the image, the image can be completely eliminated without almost leaving color residues. Accordingly, use of the composition of the present invention makes it possible to conduct coloring and decoloring repeatedly.

The composition can be utilized for the visualization of an invisible information by coating the same on the surface of a credit card, a prepaid card, etc., as a heat-sensitive recording sheet. The composition of the present invention can also be used as an output paper for an electronic information by coating the same on a paper or a plastic sheet.

While the invention has been described in detail and with reference to specific embodiments thereof, it will be apparent to one skilled in the art that various changes and modifications can be made therein without departing from the spirits and scope thereof.

What is claimed is:

1. A reversible heat-sensitive recording composition comprising a leuco compound as a coloring agent and a pyridine derivative having at least one substituent selected from the group consisting of a carboxyl group and a phenolic hydroxyl group.

2. The reversible heat-sensitive recording composition of claim 1, wherein the pyridine derivative is represented by the following formula

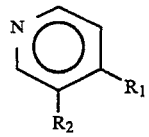

wherein $R_1$ represents a carboxyl group or a phenolic hydroxyl group and $R_2$ represents hydrogen atom, a carboxyl group, or a phenolic hydroxyl group; or by the following formula

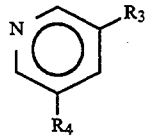

wherein $R_3$ represents a carboxyl group or a phenolic hydroxyl group and $R_4$ represents hydrogen atom, a carboxyl group, or a phenolic hydroxyl group.

3. The reversible heat-sensitive recording composition of claim 1, wherein the leuco compound is used in an amount of from 0.1 to 1.0 part by weight per 1 part by weight of the pyridine derivative.

4. The reversible heat-sensitive recording composition of claim 1, which further comprises a binder.

5. The reversible heat-sensitive recording composition of claim 1, wherein the binder is used in an amount of 5 parts by weight or less per 1 part by weight of the pyridine derivative.

6. A reversible heat-sensitive recording sheet comprising a substrate having formed thereon a recording layer containing a leuco compound as a coloring agent and a pyridine derivative having at least one substituent selected from the group consisting of a carboxyl group and a phenolic hydroxyl group.

7. The reversible heat-sensitive recording sheet of claim 6, wherein the pyridine derivative is represented by the following formula

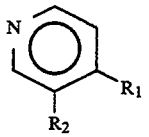

wherein $R_1$ represents a carboxyl group or a phenolic hydroxyl group and $R_2$ represents hydrogen atom, a carboxyl group, or a phenolic hydroxyl group; or by the following formula

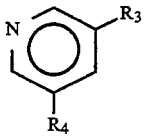

wherein $R_3$ represents a carboxyl group or a phenolic hydroxyl group and $R_1$ represents hydrogen atom, a carboxyl group, or a phenolic hydroxyl group.

* * * * *